US009424816B2

(12) United States Patent
Saito et al.

(10) Patent No.: US 9,424,816 B2
(45) Date of Patent: Aug. 23, 2016

(54) ELECTRIC STRINGED INSTRUMENT HAVING A PIVOTABLE BODY

(71) Applicant: YAMAHA CORPORATION, Hamamatsu-shi, Shizuoka-ken (JP)

(72) Inventors: Konyo Saito, Hamamatsu (JP); Hiroyuki Tsuruhashi, Hamamatsu (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 82 days.

(21) Appl. No.: 14/061,877

(22) Filed: Oct. 24, 2013

(65) Prior Publication Data

US 2014/0116226 A1 May 1, 2014

(30) Foreign Application Priority Data

Oct. 29, 2012 (JP) ..... 2012-237815

(51) Int. Cl.
*G10D 3/00* (2006.01)
*G10D 1/08* (2006.01)

(52) U.S. Cl.
CPC . *G10D 3/00* (2013.01); *G10D 1/085* (2013.01)

(58) Field of Classification Search
USPC ..... 84/290, 291
See application file for complete search history.

(56) References Cited

U.S. PATENT DOCUMENTS

| | | | | |
|---|---|---|---|---|
| 2,802,386 | A * | 8/1957 | Crosby | 84/726 |
| D249,387 | S | 9/1978 | Hart | |
| 4,178,081 | A * | 12/1979 | Metcalfe | G02C 5/22 16/228 |
| 4,873,908 | A * | 10/1989 | Moore | G10D 1/085 211/84 |
| 5,442,986 | A | 8/1995 | Cota | |
| 5,994,633 | A | 11/1999 | Norton | |
| 6,255,656 | B1 * | 7/2001 | Stark | 250/363.08 |
| 6,791,022 | B2 * | 9/2004 | Green | 84/731 |
| 7,112,732 | B2 * | 9/2006 | Tamura | 84/290 |
| 7,579,535 | B2 * | 8/2009 | Pyper-Scott | 84/293 |
| 2007/0289427 | A1 | 12/2007 | Liang | |
| 2009/0084243 | A1 * | 4/2009 | Pyper-Scott | 84/293 |

FOREIGN PATENT DOCUMENTS

| | | | |
|---|---|---|---|
| CN | 2010036949 | Y | 3/2008 |
| CN | 201936587 | U | 8/2011 |
| JP | 54-35719 | A | 3/1979 |
| JP | 54-35719 | S | 3/1979 |
| JP | 2003-157080 | A | 5/2003 |

OTHER PUBLICATIONS

Branch Guitar, http://www.branchguitars.com/about.html, https://web.archive.org/web/20100507123957/http://www.branchguitars.com/aluminumframe.html, May, 7, 2010.*

European Search Report issued in European counterpart application No. EP13020122.1, dated Jan. 17, 2014.

Official Action issued in Chinese Appln. No. 201310516930.8 mailed Feb. 3, 2016. English translation provided.

* cited by examiner

*Primary Examiner* — Christopher Uhlir
(74) *Attorney, Agent, or Firm* — Rossi, Kimms & McDowell LLP

(57) ABSTRACT

An electric stringed instrument includes: an instrument main body which includes a front surface including a structure configured to hold a string; and a pair of frames which are connected to the instrument body. At least one of the pair of frames is a movable frame rotating toward the other one of the pair of frames with a longitudinal direction of the instrument main body serving as a rotating axis while going around a rear surface side of the instrumental body.

15 Claims, 8 Drawing Sheets

ELECTRIC STRINGED INSTRUMENT HAVING A PIVOTABLE BODY

BACKGROUND OF THE INVENTION

1. Field of the Invention

The present invention relates to an electric stringed instrument.

Priority is claimed on Japanese Patent Application No. 2012-237815, filed on Oct. 29, 2012, the content of which is incorporated herein by reference.

2. Description of Related Art

In a related art, there are electric stringed instruments which include a pickup device which detects vibration of a string, such as an electric guitar and an electric violin. Among such electric stringed instruments, there is an instrument having a long instrument main body in which the predetermined number of strings are installed, and frames which have a shape corresponding to a body of an acoustic instrument such as an acoustic guitar. The frames are provided at both sides (both side surfaces) of the instrument main body (for example, see Japanese Unexamined Patent Application, First Publication No. 2003-157080). In this type of electric stringed instrument, the frames are detachably attached to the instrument main body by fixing the frames to the instrument main body using a screw or a press fit. Accordingly, the electric stringed instrument can be carried in a compact manner or the storage space of the electric stringed instrument can be made smaller by detaching the frame from the instrument main body.

However, handling of the above-mentioned electric stringed instrument is troublesome. For example, since the frames are separated from the instrument main body, there is a concern that the frames are misplaced or lost after detaching the frames from the instrument main body. In addition, there is also a concern that the frames may be unexpectedly detached from the instrument main body at the time of playing the electric stringed instrument. Further, it is necessary to perform attaching or detaching of the frames with respect to the instrument main body. Accordingly, there is a problem in that preparation before playing or packing-up after playing is troublesome.

SUMMARY OF THE INVENTION

The invention has been conceived in consideration of these circumstances and an object thereof is to provide an electric stringed instrument which can be made compact at the time of transportation or storage and is easily handled.

An electric stringed instrument according to an aspect of the present invention includes: an instrument main body which includes a front surface including a structure configured to hold a string; and a pair of frames which are connected to the instrument body. At least one of the pair of frames is a movable frame rotating toward the other one of the pair of frames with a longitudinal direction of the instrument main body serving as a rotating axis while going around a rear surface side of the instrumental body.

According to the electric stringed instrument, at least one of the pair of frames is a movable frame rotating toward the other one of the pair of frames. Therefore, it is possible to make the electric stringed instrument compact. Accordingly, the electric stringed instrument can be easily carried or the storage space of the electric stringed instrument can be made smaller.

In addition, according to the electric stringed instrument, the movable frame is connected to the instrument main body.

Accordingly, the frame is not separated from the instrument main body. Therefore, it is possible to prevent misplacement or loss of the frame, unlike the related art. In addition, since it is possible to prevent unexpected detachment of the frame at the time of playing the electric stringed instrument, it is possible to easily handle the electric stringed instrument.

According to the electric stringed instrument, the movable frame rotates toward the other one of the pair of frames while going around the rear surface side of the instrumental body. Accordingly, it is possible to prevent interference of the movable frame to a string stretched over a front surface side of the instrument main body. That is, it is possible to prevent unexpected change of a pitch of a string or damage on the string, caused by touching the string with the movable frame.

Further, since the movable frame rotates toward the other one of the pair of frames while going around the rear surface side of the instrumental body, it is possible to perform tuning of the strings in a state where the electric stringed instrument is folded up.

It is preferable that the electric stringed instrument according to the aspect of present invention, further includes: a fixation mechanism which fixes the movable frame so as to prevent rotation of the movable frame with respect to the instrument main body, and the fixation mechanism fixes the movable frame in a state where the pair of frames are respectively disposed at both side surface sides of the instrument main body.

If the movable frame is fixed as described above, at the time of playing the electric stringed instrument by a player, rotation movement of the movable frame is prevented by the fixation mechanism, even if the movable frame is abutted by a part (arm or leg, chest, abdomen, or the like) of the body of the player. Therefore, the player can play the electric stringed instrument in a stable state.

In the electric stringed instrument according to the aspect of the invention, it is preferable that the fixation mechanism fixes the movable frame in a state where the pair of frames are superposed on each other.

According to the above-described electric stringed instrument, it is possible to easily carry the electric stringed instrument in a state where the electric stringed instrument is folded up.

In the electric stringed instrument according to the aspect of the invention, it is preferable that the movable frame includes a connecting end portion connected to the instrument main body, and the fixation mechanism includes a pair of clamping parts provided on the instrument main body, the pair of clamping parts fixing the connecting end portion by clamping the connecting end portion from the longitudinal direction of the instrument main body.

In this configuration, by only causing the movable frame to rotate to a position where the pair of clamping parts are placed, the connecting end portion of the movable frame is clamped by the pair of clamping parts, and accordingly the movable frame can be easily fixed to the instrument main body. In addition, in order to cause the movable frame to rotate from the fixed state, it is only required to apply a force greater than a clamping force of the pair of clamping parts to the movable frame. Therefore, preparation for playing or packing-up can be performed in a short time.

In the electric stringed instrument according to the aspect of the invention, it is preferable that the movable frame includes a connecting end portion connected to the instrument main body, the connecting end portion extending from the rotating axis in a radial direction of the rotating axis, the fixation mechanism includes a locking groove and a biasing member, the locking groove is recessed from a surface of the instrument main body in the longitudinal direction of the instrument main body, the locking groove extending in a radial direction of the rotating axis, the locking groove being configured so that the connecting end portion is inserted into the locking groove, and the biasing member biases the connecting end portion to a direction in which the locking groove is to be inserted.

In this configuration, by only causing the movable frame to rotate to a position where the locking groove is formed, the connecting end portion of the movable frame is inserted to the locking groove by a biasing force of the biasing member. In this inserted state, since extending directions of the connecting end portion and the locking groove are matched to each other, the rotation movement of the connecting end portion is prevented and the movable frame is fixed to the instrument main body. That is, the movable frame can be easily fixed to the instrument main body. In addition, in order to cause the movable frame to rotate from the fixed state, the connecting end portion may be extracted from the locking groove by resisting the biasing force of the biasing member. Therefore, preparation for playing or packing-up can be performed in a short time.

In the electric stringed instrument according to the aspect of the invention, it is preferable that the movable frame includes a connecting end portion connected to the instrument main body, the fixation mechanism includes a pressing screw which is screwed in the instrument main body in the longitudinal direction thereof, the pressing screw pressing the connecting end portion to the instrument main body, and the pressing screw is penetrated through the connecting end portion so as to rotatably connect the movable frame to the instrument main body.

In this configuration, by only pressing the connecting end portion of the movable frame to the instrument main body with a pressing screw, the movable frame can be easily fixed to an arbitrary rotation position. If the movable frame which abuts a body of a player, can be fixed to the arbitrary rotation position, the player can play the electric stringed instrument with various desirable poses. That is, it is possible to improve a degree of freedom of play achieved by the electric stringed instrument.

In addition, in the configuration, since the pressing screw also has a function of connecting the movable frame to the instrument main body, the number of component parts of the electric stringed instrument is decreased, and the manufacturing cost thereof can be lowered.

In the electric stringed instrument according to the aspect of the invention, it is preferable that the pair of frames include first and second frames, the first frame is able to be positioned at a first side surface side of the instrument main body, the second frame is able to be positioned at a second side surface side of the instrument main body, the first and second side surface sides differing from each other, and the first frame rotates from the first side surface side to the second side surface side while going around the rear surface side, so that the first frame is superimposed on the second frame.

In the configuration, by causing the first frame to be superimposed on the second frame, it is possible to make the electric stringed instrument compact, compared to a case where first and second frames are placed at both side surface sides of the instrument main body.

In the electric stringed instrument according to the aspect of the invention, the fixation mechanism may include a magnetic force-attracting unit which is provided on the instrument main body and attracts and fixes the connecting end portion of the movable frame which is connected to the instrument main body, by a magnetic force.

In this configuration, by only causing the movable frame to rotate to a position where the magnetic force-attracting unit is placed, the connecting end portion of the movable frame is attracted to the magnetic force-attracting unit by the magnetic force. Accordingly the movable frame can be easily fixed to the instrument main body. In addition, in order to cause the movable frame to rotate from the fixed state, it is only required to apply a force greater than the magnetic force acting between the magnetic force-attracting unit and the connecting end portion in the rotation direction of the movable frame. Therefore, preparation for playing or packing-up can be performed in a short time.

In the electric stringed instrument according to the aspect of the invention, it is preferable that, only the first frame is the movable frame and the second frame is fixed to a side surface side of the instrument main body.

In a case where the electric stringed instrument is an electric guitar, when playing the electric stringed instrument by a player sitting on a chair or the like, one of a pair of frames may be disposed at a lower side of the instrument main body and be put on a leg (thigh) of the player.

Herein, if the second frame which is fixed to the instrument main body as described above is put on the leg of the player, the instrument main body is stably placed on the leg of the player by the second frame. Accordingly, even if the first frame unexpectedly rotate with respect to the instrument main body, the play can be continued.

According to an embodiment of the present invention, at least one of a pair of frames is set to be a movable frame rotatably connected with respect to the instrument main body. Therefore, the electric stringed instrument can be made compact, and the leaving or loss of the frame and the detachment of the frame at the time of playing the electric stringed instrument are prevented so as to allow easy handling of the electric stringed instrument.

DETAILED DESCRIPTION OF THE INVENTION

First Embodiment

Hereinafter, a first embodiment of the present invention will be described with reference to FIGS. 1 to 7.

Figure 1:
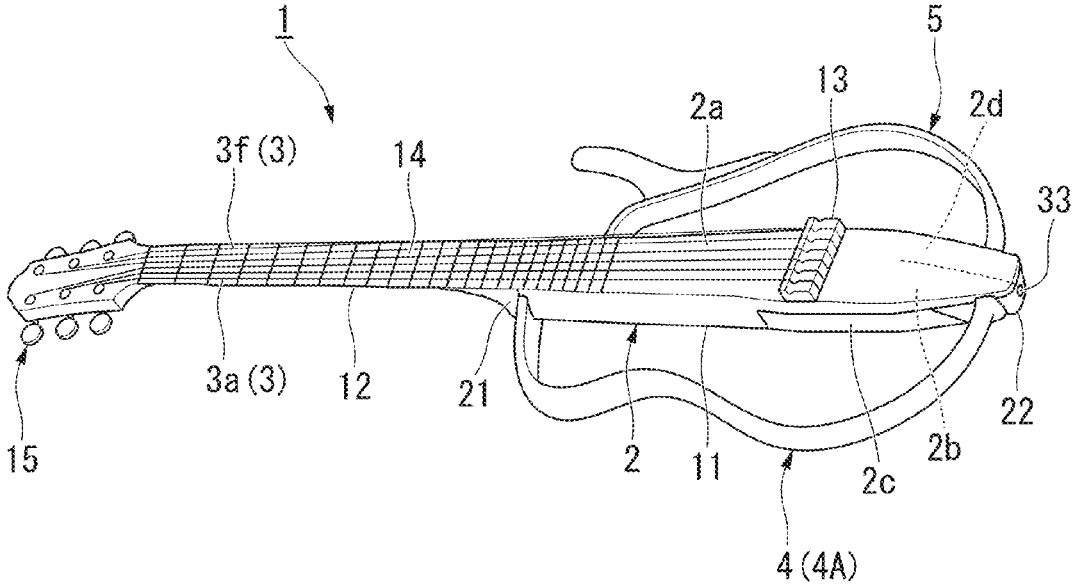
FIG. 1 is an electric guitar according to a first embodiment of the present invention, and is a perspective view showing a state where a first frame is placed at a first side surface side of an instrument main body.

As shown in FIG. 1, an electric guitar (electric stringed instrument) 1 according to the embodiment includes a long instrument main body 2 having a long shape, a plurality of strings 3, and a pair of frames 4 and 5. The strings 3 are stretched over a front surface 2*a* side of the instrument main body 2. The pair of frames 4 and 5 can be disposed at both sides of right and left side surfaces 2*c* and 2*d* of the instrument main body 2.

The instrument main body 2 may be made of wood, for example. The instrument main body 2 includes body part 11 and a neck part 12. The body part 11 has a long box shape. The neck part 12 extends from one end portion 21 (hereinafter, referred to as front end portion 21) of the body part 11 in a longitudinal direction.

A tail piece 13 is provided on a front surface 2*a* of the body part 11. The tail piece 13 fixes one end of each string 3. The tail piece 13 is provided on an intermediate portion of the body part 11 in the longitudinal direction. A pickup device (not shown) which detects vibration of the string 3 and converts the vibration into an electric signal is provided within the body part 11. The pickup device may be placed between the front end portion 21 of the body part 11 and the tail piece 13, in a range not being superposed onto a fingerboard 14 which will be described later. In addition, various component parts of a general electric guitar such as a preamplifier including a tone controller or a jack for taking out the output of the preamplifier to the outside (both not shown) are also provided on the body part 11.

The neck part 12 includes the fingerboard 14 provided on the front surface 2*a*, and including a plurality of frets. One portion of the fingerboard 14 in the longitudinal direction extends to the front end portion 21 of the body part 11. A turning peg device 15 which winds the other end portion of each string 3 is provided on an edge of the neck part 12 in an extending direction. The plurality of strings 3 are stretched between the turning peg device 15 and the tail piece 13, and are arranged at intervals in a width direction of the instrument main body 2.

Each of the frames 4 and 5 has a shape obtained by bending a belt-shaped board made of a synthetic resin, metal, or wood. Each of the frames 4 and 5 of the first embodiment is formed in the bended shape so that the pair of frames 4 and 5 has a gourd shape which is substantially the same as the appearance of a body of a general acoustic guitar.

Both end portions of each of the frames 4 and 5 in the longitudinal direction are attached to the front end portion 21 and a rear end portion 22 of the body part 11, respectively.

Figure 2:
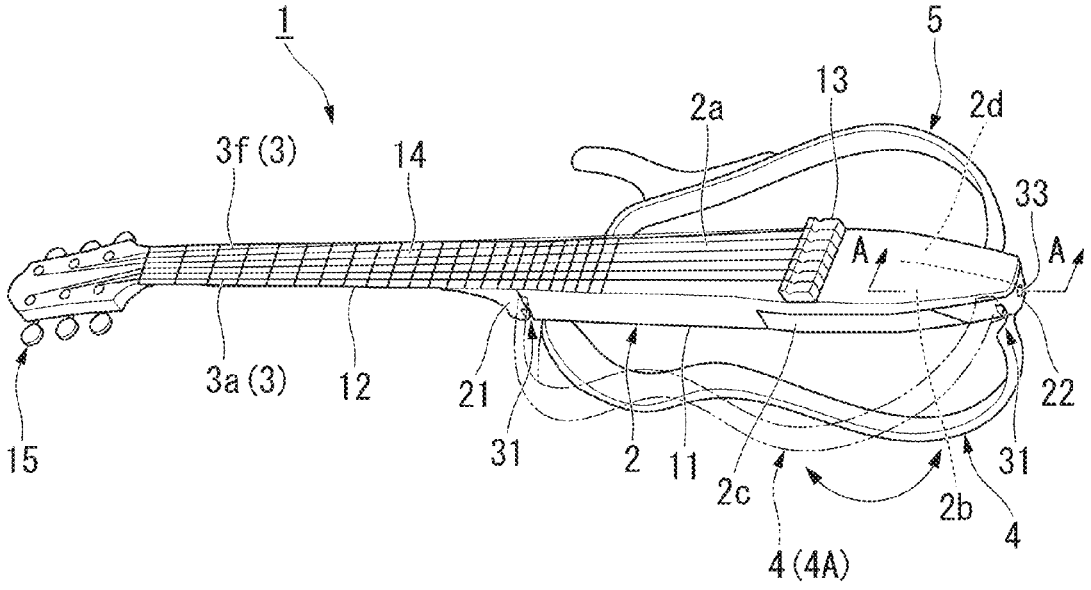
FIG. 2 is a perspective view showing a state where the first frame is placed at a rear surface side of the instrument main body, in the electric guitar of FIG. 1.
Figure 3:
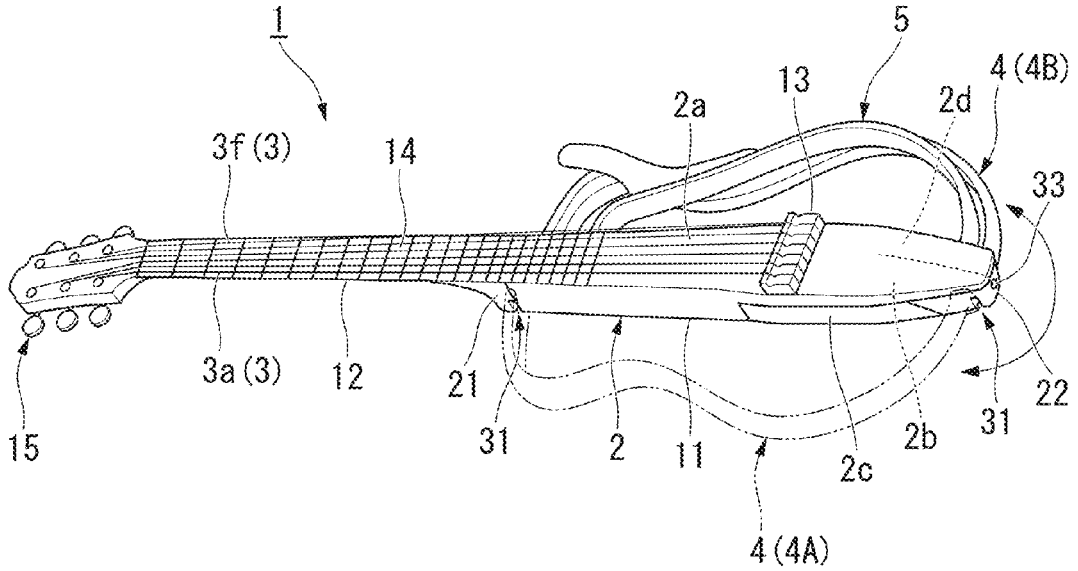
FIG. 3 is a perspective view showing a state where the first frame is placed at a second side surface side of the instrument main body, in the electric guitar of FIGS. 1 and 2.
Figure 4:
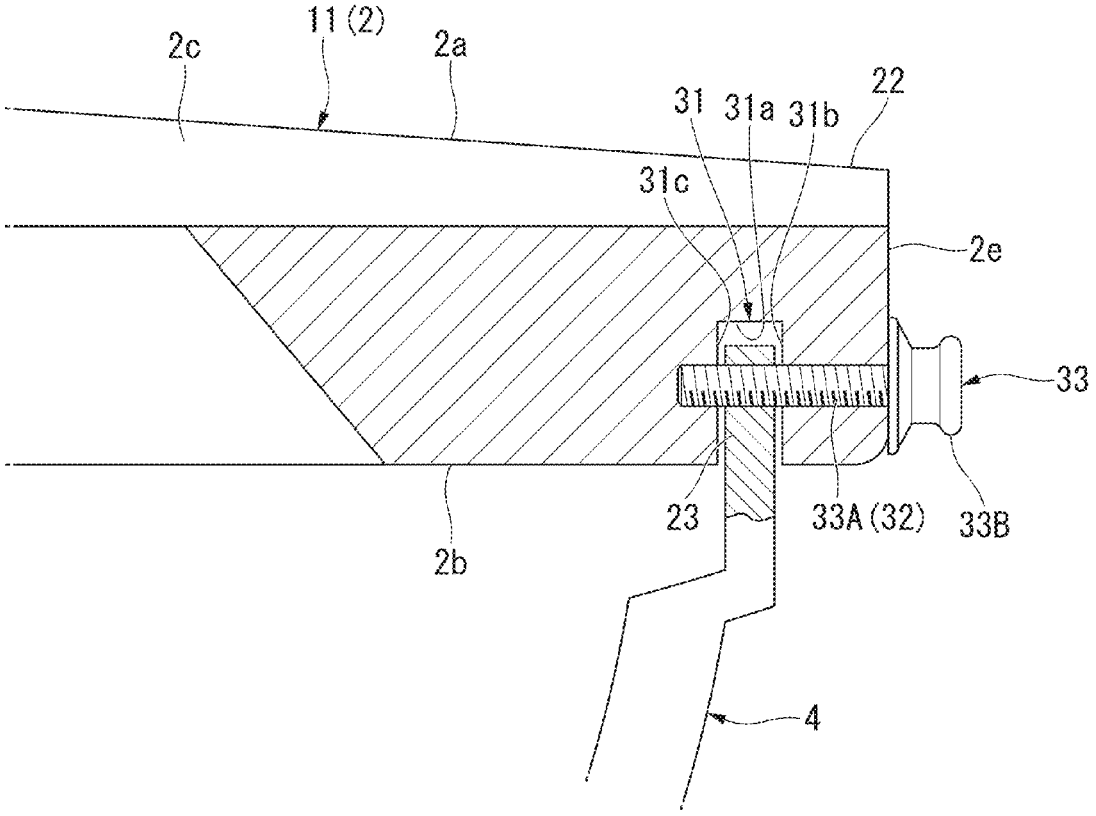
FIG. 4 is a cross-sectional view taken along an arrow A-A of FIG. 2.

The first frame 4 among the pair of frames 4 and 5 is a movable frame which is rotatably connected to the body part 11 with the longitudinal direction of the body part 11 serving as a rotating axis 32 (see FIG. 4). In the first embodiment, both end portions of the first frame 4 in the longitudinal direction are connected to the body part 11. As shown in FIGS. 1 to 3, the rotation range of the first frame 4 is a range from one side surface 2*c* (hereinafter, referred to as a first side surface 2*c*) of the body part 11, around a rear surface 2*b* side, to the other side surface 2*d* (hereinafter, referred to as a second side surface 2*d*) of the body part 11. That is, the rotation angle range of the first frame 4 is set to 180 degrees.

The first side surface 2*c* of the body part 11 is a side surface (upper side surface at the time of the play) which is positioned at a side of a first string 3*a* which makes the lowest pitch among both side surfaces 2*c* and 2*d*. The second side surface 2*d* is a side surface (lower side surface at the time of the play) which is positioned at a side of a string 3 (sixth string 3*f*, for example) which makes the highest pitch.

The second frame 5 is immovably fixed to the second side surface 2*d* of the body part 11 by a screw or the like.

Accordingly, as shown in FIG. 1, in a state where the first frame 4 is placed at the first side surface 2*c* side (opened position 4A), the pair of frames 4 and 5 have a gourd shape which is substantially the same as the appearance of a body of a acoustic guitar. In addition, as shown in FIG. 3, in a state where the first frame 4 is placed on the second side surface 2*d* side (folded position 4B), the pair of frames 4 and 5 are superposed onto each other in a thickness direction of the body part 11. That is, since the first frame 4 is rotatable, the electric guitar 1 is set to be foldable.

In the state where the first frame 4 is placed in the folded position 4B, the first frame 4 and the second frame 5 may be separated from each other so that they not contact to each other.

Next, a connecting structure of one end portion (hereinafter, simply referred to as a connecting end portion 23) of the first frame 4 in the longitudinal direction and the rear end portion 22 of the body part 11 will be described in detail, with reference to FIGS. 4 to 7.

As shown in FIGS. 4 to 7, an accommodation groove 31 is formed in the rear end portion 22 of the body part 11. The accommodation groove 31 has a bottom, is recessed from the rear surface 2*b* of the body part 11, and extends in the width direction of the body part 11. Both ends of the accommodation groove 31 in the extending direction are opened to both side surfaces 2*c* and 2*d* of the body part 11, respectively. The connecting end portion 23 of the first frame 4 is positioned at the rear end portion 22 of the body part 11, and is accommodated in this accommodation groove 31.

A rotating axis 32 is placed in the accommodation groove 31, and extends in the longitudinal direction of the body part 11. The accommodation groove 31 has inner surfaces 31*b* and 31*c* which are orthogonal to the longitudinal direction of the body part 11. The rotating axis 32 is stretched between both inner surfaces 31*b* and 31*c* of the accommodation groove 31 which is orthogonal to the body portion 11 in the longitudinal direction. That is to say, the rotating axis 32 is orthogonal to the inner surfaces 31*b* and 31*c*. In the example shown in FIG. 4, the rotating axis 32 is placed in the intermediate position of the body part 11 in the width direction. However, the rotating axis 32 may be placed in a position shifted to the first side surface 2*c* or to the second side surface 2*d* from the intermediate position, for example.

The rotating axis 32 of the first embodiment is configured by a connecting screw 33 which is screwed in the longitudinal direction from a rear end surface 2*e* of the body part 11. The connecting screw 33 includes a male screw part 33A and a strap holding part 33B. The male screw part 33A forms the rotating axis 32. The strap holding part 33B is provided on one end of the male screw part 33A in the axial direction thereof.

The male screw part 33A is screwed into the body part 11 from the rear end surface 2*e* of the body part 11. The body part 11 has a screw hole into which the male screw part 33A to be screwed. The screw hole is formed so as to penetrate the accommodation groove 31 in the width direction of the accommodation groove 31. The strap holding part 33B is placed on the rear end surface 2*e* of the body part 11 in a state where the connecting screw 33 is attached to the body part 11. The strap holding part 33B is used for locking a strap (not shown) for the electric guitar 1. That is, the connecting screw 33 of the first embodiment also functions as an end pin of the electric guitar 1.

The connecting end portion 23 of the first frame 4 is positioned at the rear end portion 22 of the body part 11. The connecting end portion 23 is configured so that the male screw part 33A (rotating axis 32) penetrates through the connecting end portion 23 in a state where the connecting end portion 23 is disposed in the accommodation groove 31. With this configuration, the connecting end portion 23 of the first frame 4 is rotatable around the rotating axis 32 with respect to the instrument main body 2.

A connecting structure of the other end portion (connecting end portion 23) of the first frame 4 and the front end portion 21 of the body part 11 is the same as the connecting structure of the one end portion (connecting end portion 23) of the first frame 4 and the rear end portion 22 of the body part 11 described above, except that the connecting screw 33 which becomes the rotating axis 32 is screwed in the longitudinal direction of the body part 11 from the front end surface (not shown) of the body part 11. That is, in the same manner as the one end portion of the first frame 4, the other end portion of the first frame 4 is accommodated in the accommodation groove 31 (see FIGS. 2 and 3) which is formed in the front end portion 21 of the body part 11, and is penetrated by the male screw part 33A (rotating axis 32) of the connecting screw 33 which is also used as an end pin.

As described above, the first frame 4 is connected to the instrument main body 2. In a state where the first frame 4 is placed at the first side surface 2*c* side of the body part 11 (see FIGS. 1 and 5), and is placed at the second side surface 2*d* side of the body part 11 (see FIGS. 3 and 7), the rotation of the connecting end portion 23 of the first frame 4 toward the front surface 2*a* side of the body part 11 is prevented by a bottom portion 31*a* of the accommodation groove 3.

That is, the rotation angle range of the first frame 4 is set to 180 degrees by the bottom portion 31*a* of the accommodation groove 31.

Figure 5:
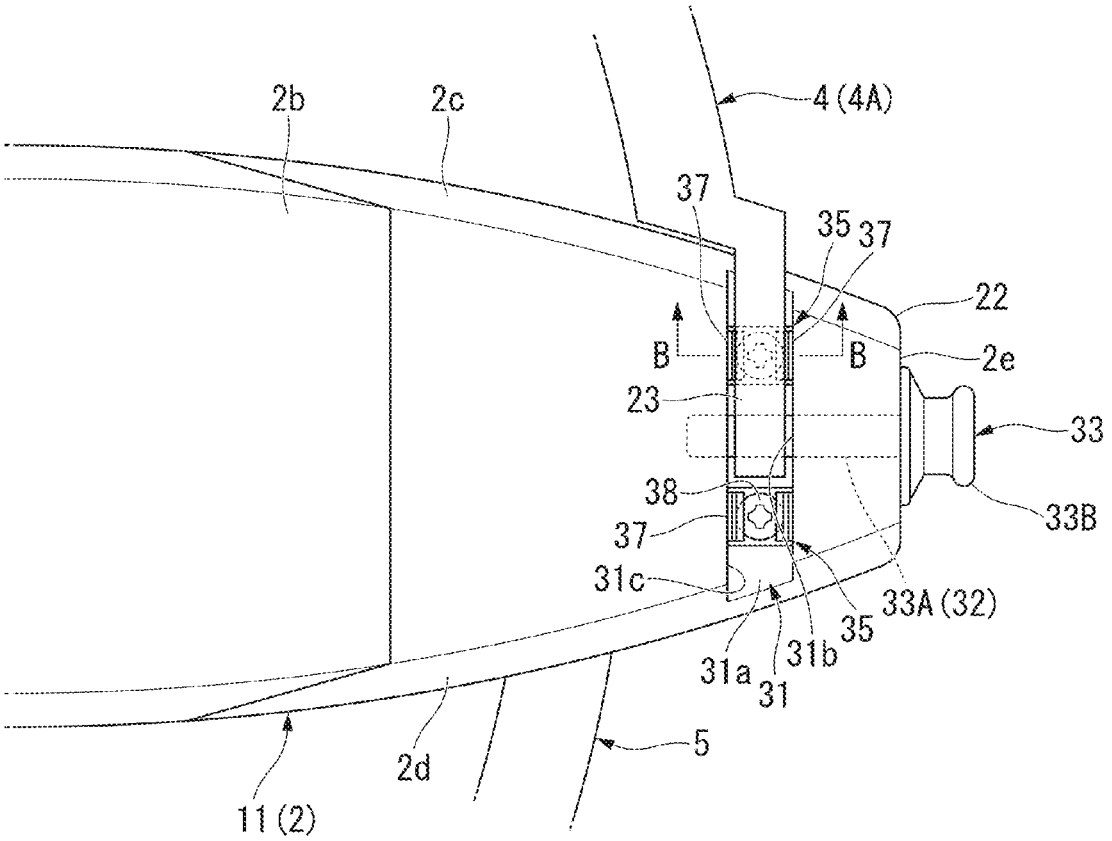
FIG. 5 is an enlarged plan view of a connected state of the first frame placed at the first side surface side and the instrument main body, seen from the rear surface side of the instrument main body, in the electric guitar of FIGS. 1 to 3.
Figure 6:
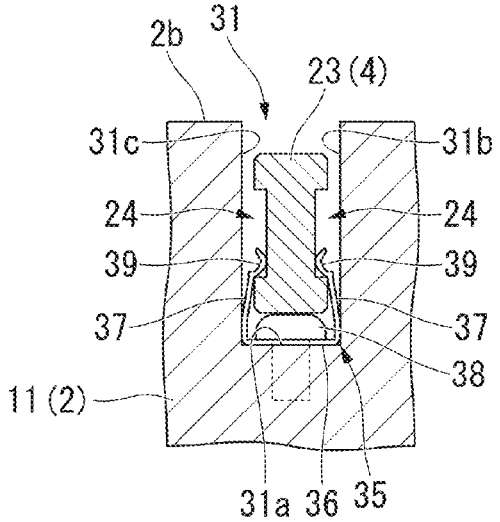
FIG. 6 is a cross-sectional view taken along an arrow B-B of FIG. 5.
Figure 7:
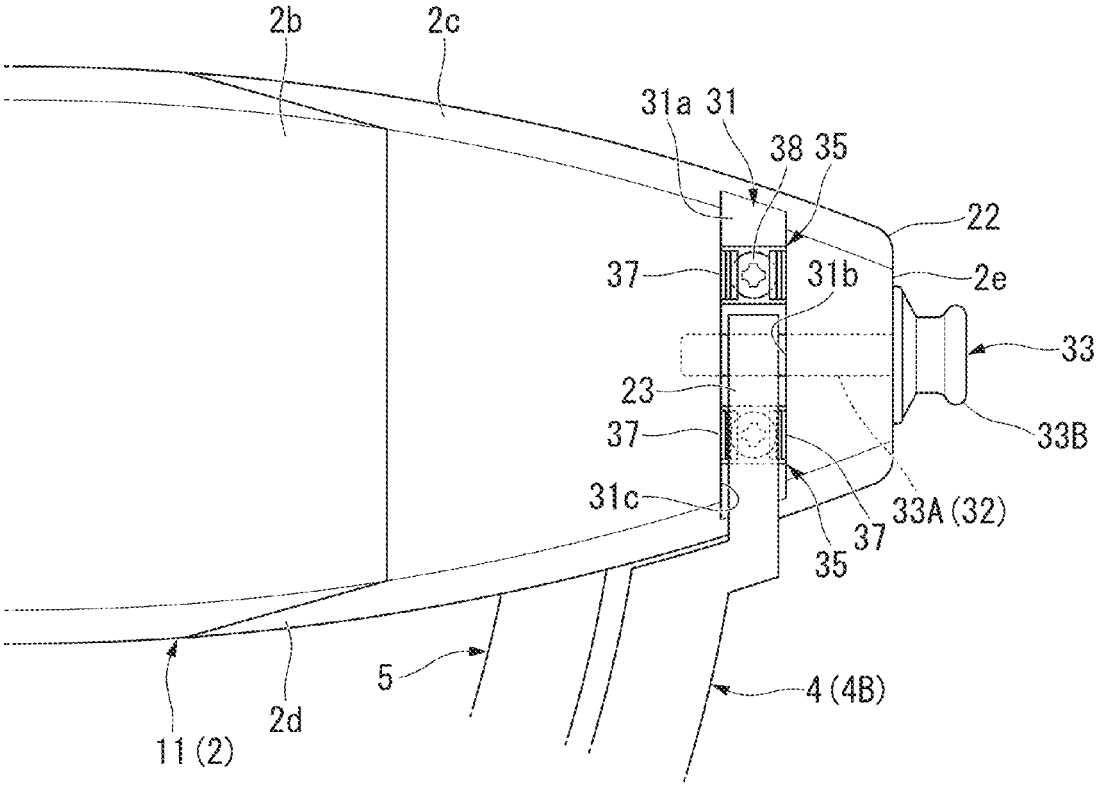
FIG. 7 is an enlarged plan view of a connected state of the first frame placed at the second side surface side and the instrument main body, seen from the rear surface side of the instrument main body, in the electric guitar of FIGS. 1 to 3.

As shown in FIGS. 5 to 7, the electric guitar 1 of the first embodiment further includes a fixation mechanism which non-rotatably fixes the first frame 4 placed in the opened position 4A and the folded position 4B with respect to the instrument main body 2. The fixation mechanism of the first embodiment includes clamping members 35 each of which is provided in the accommodation groove 31 and fixes the connecting end portion 23 of the first frame 4.

The clamping members 35 are formed by folding a plate such as elastically deformable metal. Each clamping member 35 includes a base plate part 36, and a pair of clamping parts 37 which extend from both ends of the base plate part 36 in the thickness direction of the base plate part 36. The base plate part 36 is fixed to the bottom portion 31*a* of the accommodation groove 31 by a fixing screw 38.

Each clamping part 37 extends from the bottom portion 31*a* towards the rear surface 2*b* side of the body part 11 along the inner surface 31*b* or 31*c* of the accommodation groove 31. Accordingly, the pair of clamping parts 37 are opposed to each other in the longitudinal direction of the body part 11. The pair of clamping parts 37 are elastically deformable in a direction separating from each other. Each clamping part 37 has a claw part 39. The claw parts 39 protrude in a direction approaching each other. Each claw part 39 is formed by folding each clamping parts 37.

One clamping member 35 is placed between the male screw part 33A (rotating axis 32) and the first side surface 2*c* on the bottom portion 31*a* of the accommodation groove 31. The other clamping member 35 is placed between the male screw part 33A (rotating axis 32) and the second side surface 2*d* on the bottom portion 31*a* of the accommodation groove 31. Accordingly, when the first frame 4 rotates until reaching the opened position 4A (see FIG. 5) or the folded position 4B (see FIG. 8), the connecting end portion 23 of the first frame 4 is inserted between the pair of clamping parts 37 (see FIG. 6). At that time, since the pair of clamping parts 37 are elastically deformed so as to be separated from each other, a force for clamping the connecting end portion 23 is generated by the pair of clamping parts 37. As a result, the first frame 4 is fixed to the opened position 4A or the folded position 4B.

The connecting end portion 23 of the first embodiment has recess portions 24 recessed from surfaces facing the pair of clamping parts 37. In a state where the first frame 4 is placed in the opened position 4A or the folded position 4B, the claw parts 39 of the clamping parts 37 are inserted to the recess portions 24 respectively. As a result, the connecting end portion 23 is locked by the pair of clamping parts 37 so as not to rotate from the opened position 4A or the folded position 4B. That is, in the first embodiment, the connecting end portion 23 of the first frame 4 which is placed in the opened position 4A or the folded position 4B is inserted to and locked by the pair of clamping parts 37, and accordingly the rotation movement of the first frame 4 is prevented.

In order to cause the first frame 4 fixed as described above to rotate from the opened position 4A or the folded position 4B, it is only required to apply a force greater than the clamping force of the pair of clamping parts 37 to the first frame 4.

In the example shown in FIGS. 4 to 6, a configuration in which the clamping member 35 is provided on the rear end portion 22 of the body part 11 is described. The same clamping member 35 may also be provided on the front end portion 21 of the body part 11.

As described above, according to the electric guitar 1 of the first embodiment, as shown in FIG. 3, by folding the electric guitar 1 so that the pair of frames 4 and 5 are superposed onto each other, it is possible to make the electric guitar 1 more compact, compared to a case where the pair of frames 4 and 5 are placed at side of both end surfaces 2*c* and 2*d* of the instrument main body 2. Therefore, it is possible to easily carry the electric guitar 1 and to make storage space of the electric guitar 1 smaller.

In addition, since the first frame 4 is rotatably connected with respect to the instrument main body 2, the first frame is not separated from the instrument main body 2. Therefore, it is possible to prevent misplacement or loss of the frames 4 and 5.

In addition, it is possible to prevent unexpected detachment of the frames 4 and 5 at the time of playing the electric guitar 1, and thus it is possible to easily handle the electric guitar 1.

Further, since the first frame 4 is connected to the instrument main body 2 so as to go around from the sides of the side surfaces 2*c* and 2*d* to the rear surface 2*b* side, it is possible to prevent interference of the first frame 4 to the strings 3 stretched over the front surface 2*a* side of the instrument main body 2. That is, it is possible to prevent unexpected change of the pitch of the strings 3 or damage on the strings 3 by touching of strings 3 with the first frame 4. In addition, it is possible to perform tuning of the strings 3 in a state where the electric guitar 1 is folded up.

In the electric guitar 1 of the first embodiment, the first frame 4 is fixed to the opened position 4A by the fixation mechanism. Therefore, at the time of playing the electric guitar 1 by a player, rotation movement of the first frame 4 with respect to the instrument main body 2 does not occur, even if the first frame 4 is abutted by a part (arm or leg, chest, abdomen, or the like) of the body of the player. Accordingly, the player can play the electric guitar 1 in a stable state.

In addition, the first frame 4 is fixed to the folded position 4B by a fixation mechanism. Therefore, it is possible to easily carry the electric guitar 1 in a folded state.

In the first embodiment, the fixation mechanism is configured by the clamping member 35 which clamps the connecting end portion 23 of the first frame 4 from the longitudinal direction of the instrument main body 2. Therefore, by only moving the first frame 4 to the opened position 4A or the folded position 4B, it is possible to stably and easily fix the first frame 4 to the instrument main body 2, without getting a finger caught between the instrument main body 2 and the first frame 4. In addition, in order to cause the first frame 4 to rotate from this fixed state, it is only required to apply a force greater than the clamping force of the pair of clamping parts 37 to the first frame 4. Accordingly, preparation for playing or the packing-up can be performed in a short time.

In the first embodiment, since the connecting screw 33 is also used as the rotating axis 32 for the first frame 4 and the end pin of the electric guitar 1, the number of component parts of the electric guitar 1 can be decreased.

In a case where a player plays the electric guitar 1 of the first embodiment sitting on a chair or the like, the second frame 5 which is fixed to the instrument main body 2 is placed at a lower side of the instrument main body 2, and is put on a leg (thigh) of the player. Accordingly, the instrument main body 2 is stably placed on the leg of the player by the second frame 5. Therefore, according to the electric guitar 1 of the first embodiment, even if the first frame 4 unexpectedly rotates with respect to the instrument main body 2, the play can be continued.

In the first embodiment described above, in a case of considering only the stable play of the electric guitar 1, the fixation mechanism may be configured to fix the first frame 4 only when the first frame 4 is positioned in the opened position 4A. In this case, it is sufficient that the clamping member 35 configuring the fixation mechanism is only provided between the male screw part 33A (rotating axis 32) and the first side surface 2*c* of the body part 11 on the bottom portion 31*a* of the accommodation groove 31.

The pair of clamping parts 37 which clamp the connecting end portion 23 are not limited to be integrally formed by the elastically deformable board. The clamping parts 37 may be separately formed. In the case where the clamping parts 37 are separately formed, they may be provided at the inner surfaces 31*b* and 31*c* of the accommodation groove 31 so as to oppose each other, respectively. In addition, in this case, a degree of freedom for disposing the pair of clamping parts 37 becomes high. Therefore, for example, the pair of clamping parts 37 can fix the first frame 4 to a predetermined rotation position (for example, position with 90 degrees) other than the folded position 4B or the opened position 4A.

Second Embodiment

Next, a second embodiment of the present invention will be described with reference to FIGS. 8 to 10.

An electric guitar 1 of the second embodiment differs from that of the first embodiment only in the configuration of the fixation mechanism. Other than the fixation mechanism, the configurations of the electric guitar 1 of the second embodiment are the same as those of the first embodiment. In the second embodiment, the same reference symbols are given to constituent elements which are the same as the first embodiment, and the descriptions thereof are omitted.

Figure 8:
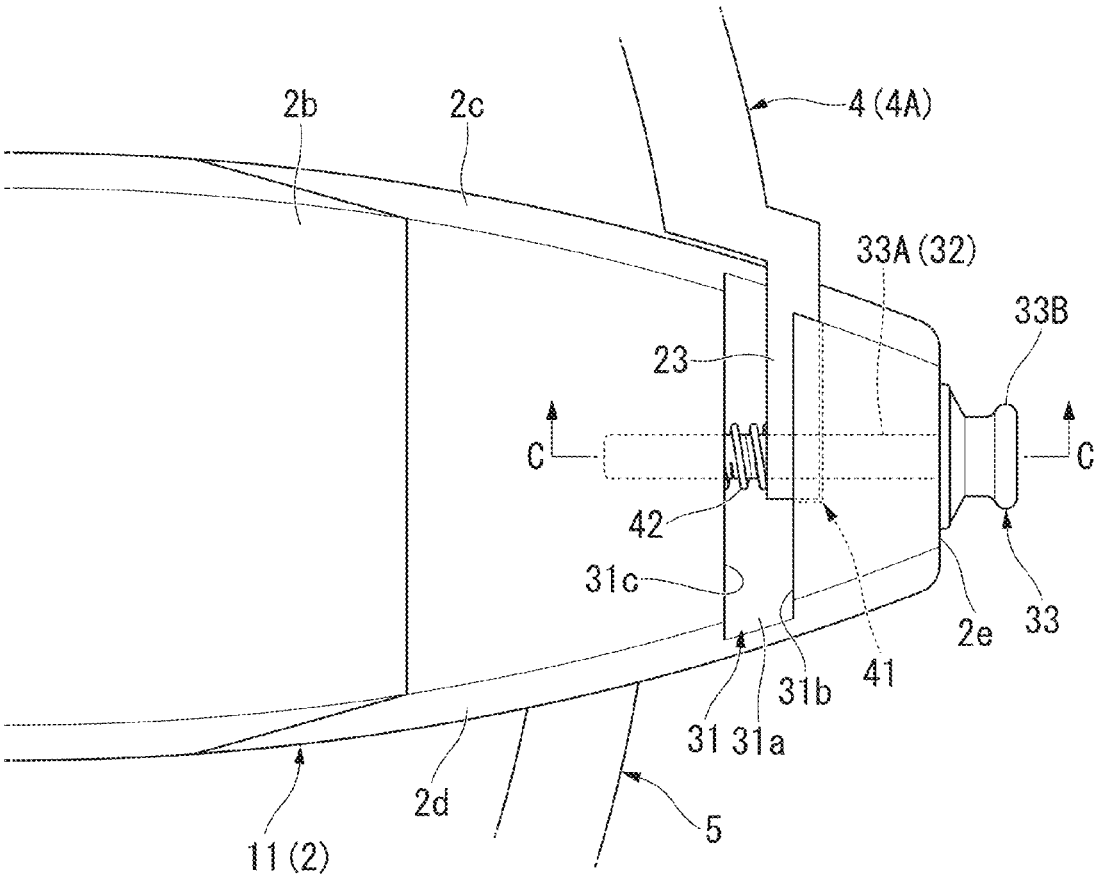
FIG. 8 is an enlarged cross-sectional view of a connected portion of a first frame placed at a first side surface side and an instrument main body, seen from a rear surface side of an instrument main body, in an electric guitar according to a second embodiment of the present invention.
Figure 9:
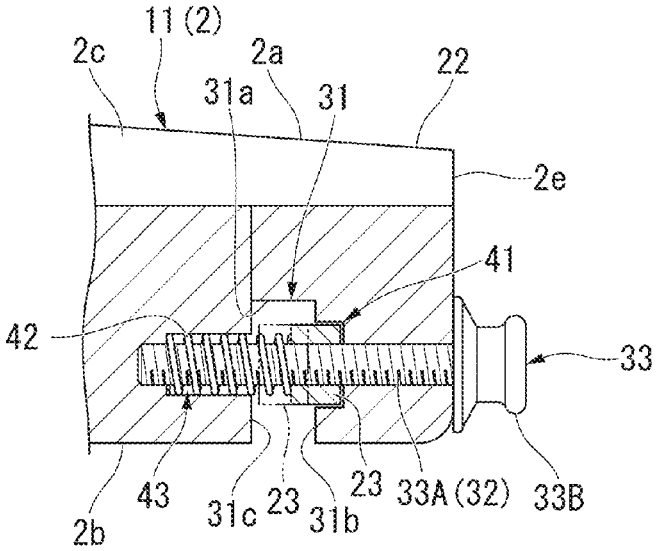
FIG. 9 is a cross-sectional view taken along an arrow C-C of FIG. 8.

FIGS. 8 and 9 show the fixation mechanism of the electric guitar 1 of the second embodiment. The fixation mechanism includes a locking groove 41 and a coil spring (biasing member) 42. The locking groove 41 is formed in the body part 11 of the instrument main body 2, and is configured so that the connecting end portion 23 of the first frame 4 can be inserted therein. The coil spring 42 is attached to the rotating axis 32.

The locking groove 41 is recessed in the longitudinal direction of the body part 11 from an inner surface (surface) of the accommodation groove 31, and extends in the radial direction of the rotating axis 32.

More specifically, the locking groove 41 of the second embodiment is formed in the inner surface 31*b* of the accommodation groove 31. The inner surface 31*b* is closer to the rear end portion 22 (and the rear end surface 2*e*) than the inner surface 31*c*. The locking groove 41 mainly extends from the rotating axis 32 to the first side surface 2*c* of the body part 11 along the width direction of the body part 11. The locking groove 41 is opened to the outside from the first side surface 2*c* while it is not opened to the rear surface 2*b* of the body part 11. The dimension of the locking groove 41 in the extending direction thereof is set to be equal to or slightly greater than that of the portion of the connecting end portion 23 which is to be accommodated in the locking groove 41 when the first frame 4 is placed in the opened position 4A. With this configuration, the connecting end portion 23 of the first frame 4 can be inserted to the locking groove 41, only in a state where the first frame 4 is placed in the opened position 4A.

Figure 10:
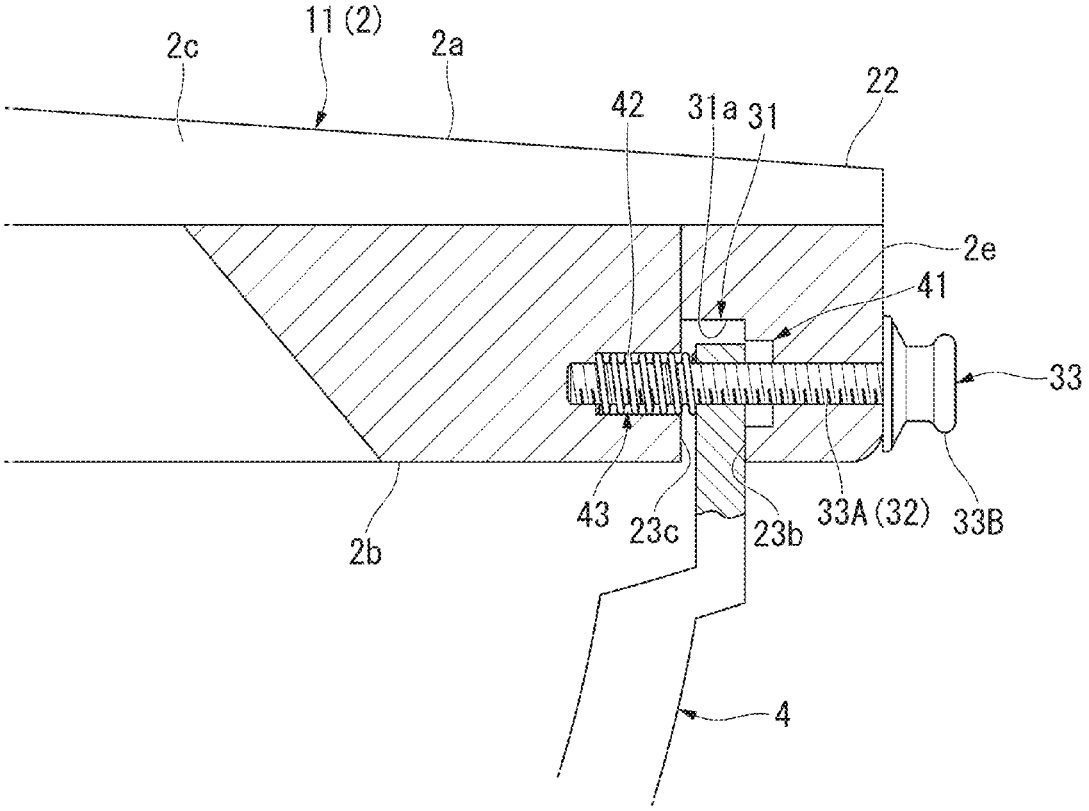
FIG. 10 is an enlarged cross-sectional view showing a connected portion of the first frame placed at a rear surface side of the instrument main body and the instrument main body, in the electric guitar of FIGS. 9 and 10.

In the example shown in FIGS. 8 to 10, a depth dimension of the locking groove 41, which is recessed from the inner surface 31*b* of the accommodation groove 31, is set so that only a part of the connecting end portion 23 is inserted into the locking groove 41. Alternatively, the depth dimension of the locking groove 41 may be set so that the entire connecting end portion 23 is inserted into the locking groove 41.

The coil spring 42 is placed so as to bias the connecting end portion 23 which is placed in the accommodation groove 31, in the longitudinal direction of the body part 11 towards the locking groove 41. Hereinafter, the disposition of the coil spring 42 will be described in detail.

An accommodation hole 43 is formed in the inner surface 31*c* opposing the inner surface 31*b*, and forms the locking groove 41. The accommodation hole 43 is concentric with the male screw part 33A (rotating axis 32), and has a greater radial dimension than that of the male screw part 33A (rotating axis 32). The coil spring 42 is inserted in the accommodation hole 43 in a state where the male screw part 33A (rotating axis 32) inserted in the coil spring 42. The coil spring 42 is placed at the front end portion 21 side of the body part 11 with respect to the connecting end portion 23, and accordingly biases the connecting end portion 23 to the rear end portion 22 side of the body part 11.

In the example shown in FIGS. 8 to 10, the locking groove 41 and the coil spring 42 are provided in the rear end portion 22 of the body part 11. The same locking groove 41 and the coil spring 42 may also be provided in the front end portion 21 of the body part 11. Alternatively, the coil spring 42 may be provided only at one of the front end portion 21 and the rear end portion 22 of the body part 11.

The operation of the fixation mechanism of the second embodiment configured as described above will be described.

In a state where the first frame 4 is placed in the rotation position other than the opened position 4A, the connecting end portion 23 is pressed to the inner surface 31*b* by the biasing force of the coil spring 42, as shown in FIG. 10, for example. If the first frame 4 rotates from the above-described rotation position to the opened position 4A, the connecting end portion 23 is inserted to the locking groove 41 by the biasing force of the coil spring 42, as shown in FIGS. 8 and 9. In the inserted state, since the extending directions of the connecting end portion 23 and the locking groove 41 are matched with each other, the rotation movement of the connecting end portion 23 is prevented, and thus the first frame 4 is fixed to the instrument main body 2.

That is, in the electric guitar according to the second embodiment, by only causing the first frame 4 to rotate to the opened position 4A, it is possible to stably and easily fix the first frame 4 to the instrument main body 2, without getting a finger caught between the instrument main body 2 and the first frame 4. In order to cause the first frame 4 to rotate from this fixed state, the connecting end portion 23 may be extracted from the locking groove 41 by resisting the biasing force of the coil spring 42. Therefore, preparation for playing or packing-up can be performed in a short time.

In addition, in the electric guitar according to the second embodiment, the same advantages as the first embodiment described above are also obtained.

In the second embodiment, the first frame 4 is fixed to the instrument main body 2 only in a case where the first frame 4 is placed in the opened position 4A. In addition to this, the first frame may be fixed to a predetermined rotation position such as the folded position 4B, for example. In the case where the first frame 4 is fixed both in the opened position 4A and the folded position 4B, the locking groove 41 may be extended along the width direction of the body part 11 so as to be opened to both the first side surface 2*c* and the second side surface 2*d*.

In the example shown above, the coil spring 42 is placed so as to always bias the connecting end portion 23; however, it is not limited to this configuration. The coil spring 42 may be placed so as to bias the connecting end portion 23 only when the connecting end portion 23 is placed in a position where it can be inserted to the locking groove 41. Further, the biasing member which biases the connecting end portion 23 is not limited to the coil spring 42. The biasing member may be a leaf spring or rubber, for example.

In addition, the fixation mechanism of the second embodiment may be combined with the fixation mechanism of the first embodiment. For example, the locking groove 41 and the coil spring 42 may be provided so as to fix the first frame 4 to the opened position 4A, and the clamping member 35 may be provided so as to fix the first frame 4 to the folded position 4B.

Third Embodiment

Next, a third embodiment of the present invention will be described with reference to FIG. 11.

An electric guitar 1 of the third embodiment differs from those of the first and second embodiments only in the configuration of the fixation mechanism. Other than the fixation mechanism, the configurations of the electric guitar 1 of the third embodiment are the same as those of the first embodiment. In the third embodiment, the same reference symbols are given to constituent elements which are the same as the first and second embodiments, and the descriptions thereof are omitted.

Figure 11:
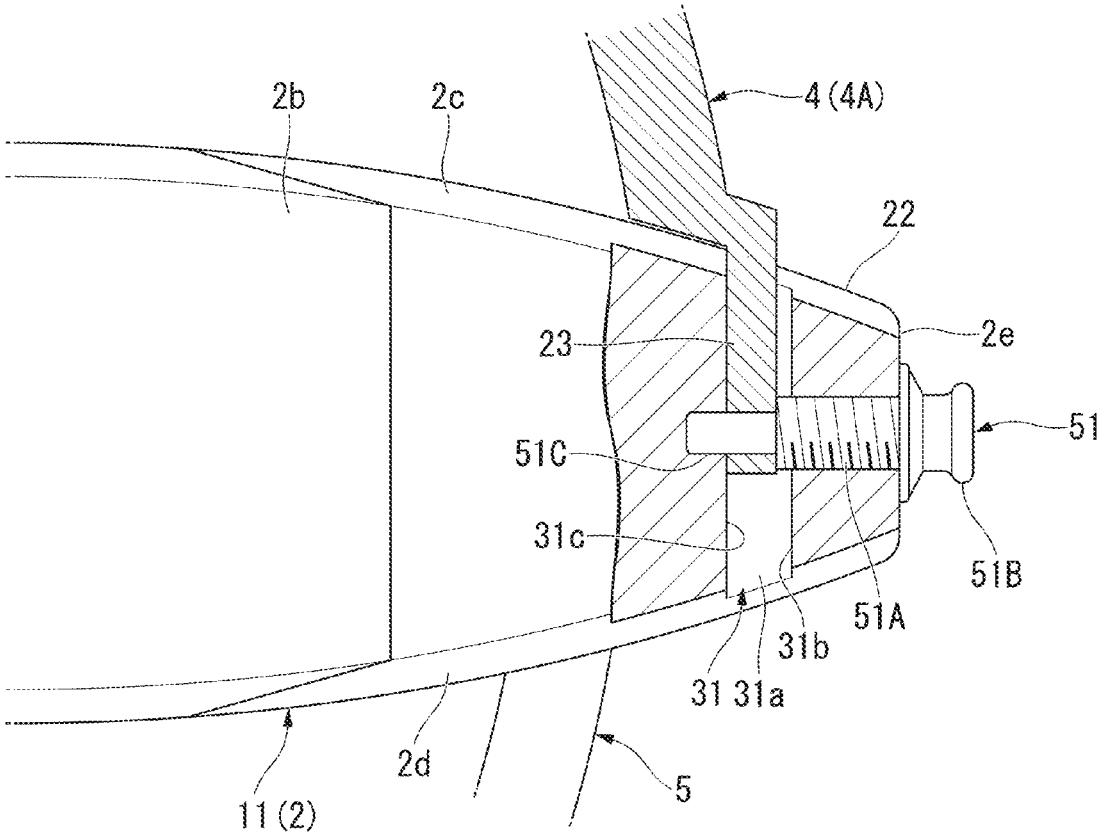
FIG. 11 is an enlarged cross-sectional view of a connected portion of an instrument main body and a first frame seen from a rear surface side of an instrument main body, in an electric guitar according to a third embodiment of the present invention.

FIG. 11 shows the fixation mechanism of the electric guitar 1 of the third embodiment. The fixation mechanism includes a pressing screw 51 which presses and fixes the connecting end portion 23 of the first frame 4 to the instrument main body 2.

The pressing screw 51 is screwed in the longitudinal direction of the body part 11 from the rear end surface 2*e* of the body part 11. The pressing screw 51 includes a male screw part 51A, a strap holding part 51B, and an inserted part 51C. The strap holding part 51B is provided on one end of the male screw part 51A in the axial direction. The inserted part 51C is provided on the other end of the male screw part 51A in the axis direction. The strap holding part 51B is the same as the strap holding part 33B of the connecting screw 33 of the first and second embodiments.

In the same manner as the male screw part 33A of the connecting screw 33 of the first and second embodiments, the inserted part 51C is inserted through the connecting end portion 23 of the first frame 4, and forms the rotating axis of the first frame 4 of the third embodiment. That is, in the third embodiment, the first frame 4 is rotatably connected to the instrument main body 2 by the pressing screw 51.

A radial dimension of the male screw part 51A is greater than that of the inserted part 51C, and thus the male screw part 51A is not inserted through the connecting end portion 23. In the third embodiment, the male screw part 51A is placed so as to protrude from the inner surface 31*b* into the accommodation groove 31. Accordingly, if the pressing screw 51 rotates so as to move towards the front end portion 21 from the rear end portion 22 of the body part 11, the connecting end portion 23 is pressed to the inner surface 31*c* by the male screw part 51A. That is, the male screw part 51A serves as a pressing unit which presses the connecting end portion 23 to the instrument main body 2.

In the example shown in FIG. 11, the pressing screw 51 is provided on the rear end portion 22 of the body part 11. The same pressing screw 51 may be provided on the front end portion 21 of the body part 11, for example.

In this case, the pressing screw 51 may be screwed in the longitudinal direction of the body part 11 from the front end surface (not shown) of the body part 11.

As described above, in the electric guitar 1 according to the third embodiment, the same advantages as the first embodiment described above are obtained.

Further, in the electric guitar 1 of the third embodiment, by only pressing the connecting end portion 23 of the first frame 4 to the instrument main body 2 by the pressing screw 51, it is possible to easily fix the first frame 4 to an arbitrary rotation position (including the opened position 4A and the folded position 4B). By fixing the first frame 4 which abuts the body of the player to the arbitrary rotation position, the player can play the electric guitar 1 with various desirable poses. That is, it is possible to improve a degree of freedom of play achieved by the electric guitar 1.

Since the pressing screw 51 also has a function of connecting the first frame 4 to the instrument main body 2, the number of component parts of the electric guitar 1 is decreased, and the manufacturing cost thereof can be lowered.

The fixation mechanism of the third embodiment can be suitably combined with the fixation mechanism of the first and second embodiments. In this case, the pressing screw 51 of the embodiment may be used instead of the connecting screw 33 in the configurations of the first and second embodiments.

Fourth Embodiment

Next, a fourth embodiment of the present invention will be described with reference to FIG. 12.

An electric guitar 1 of the fourth embodiment differs from that of the first embodiment only in that the electric guitar 1 of the fourth embodiment further includes an identification unit 6. Other than the identification unit 6, the configurations of the electric guitar 1 of the fourth embodiment are the same as those of the first embodiment. In the fourth embodiment, the same reference symbols are given to constituent elements which are the same as the first embodiment, and the descriptions thereof are omitted.

Figure 12:
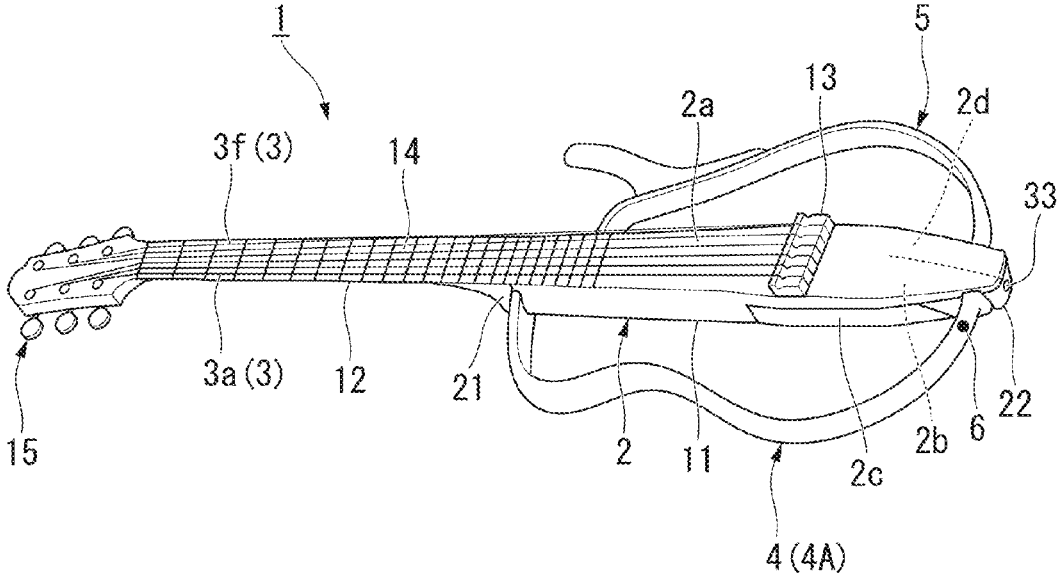
FIG. 12 is an electric guitar according to a fourth embodiment of the present invention, and is a perspective view showing a state where a first frame is placed at a first side surface side of an instrument main body.

FIG. 12 shows the electric guitar 1 of the fourth embodiment. In the example shown in FIG. 12, a black-pointed mark 6 is attached to the first frame 4 as the identification unit. By attaching the black-pointed mark 6 as the identification unit, the first frame 4 and the second frame 5 are easily identified from each other. As a result, when a user folds up the electric guitar 1, it is easy to identify the first frame 4 to be rotated.

The identification unit is not limited to the configuration described above. A black-pointed mark 6 may be attached to the second frame 5 instead of the first frame 4. Alternatively, as the identification unit, the colors or the materials of the first frame 4 and the second frame 5 may be set to be different from each other. Also in a case of configuring the identification unit as described above, the first frame 4 and the second frame 5 are easily identified from each other.

The black-pointed mark 6 (identification unit) may be attached to the electric guitars of the first to third embodiments.

Hereinabove, the first to fourth embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

For example, the fixation mechanism which fixes the first frame 4 to the instrument main body 2 may use a magnetic force. More specifically, the fixation mechanism may include a magnetic force-attracting unit which is provided on the instrument main body 2 and attracts and fixes the connecting end portion 23 by a magnetic force. In a case where the magnetic force-attracting unit is a magnet, a magnetic material such as iron or a magnet may be fixed to the connecting end portion 23, or the connecting end portion 23 or the first frame 4 may be formed by a magnetic material such as iron. In addition, in a case where the magnet is fixed to the connecting end portion 23, the magnetic force-attracting unit may be a magnetic material such as iron.

In a case where the first frame 4 is fixed to the opened position 4A or the folded position 4B by the magnetic force-attracting unit, the magnetic force-attracting unit may be provided on the bottom portion 31*a* of the accommodation groove 31 in the same manner as the clamping member 35 of the first embodiment, or it may be provided on the inner surfaces 31*b* and 31*c* of the accommodation groove 31, for example. If the magnetic force-attracting unit is provided on the inner surfaces 31*b* and 31*c* of the accommodation groove 31, the first frame 4 can be fixed to the predetermined rotation position, other than the opened position 4A or the folded position 4B.

This fixation mechanism can be suitably combined with the fixation mechanisms of the four embodiments described above.

Even when the fixation mechanism uses a magnetic force as described above, the same advantages as the first and second embodiments are obtained. That is, by only causing the first frame 4 to rotate to the position in which the magnetic force-attracting unit is placed, the connecting end portion 23 is attracted to the magnetic force-attracting unit by a magnetic force, and accordingly it is possible to stably and easily fix the first frame 4 to the instrument main body 2, without getting a finger caught between the instrument main body 2 and the first frame 4. In addition, to cause the first frame 4 to rotate from this fixed state, it is only required to apply a force greater than the magnetic force which acts between the magnetic force-attracting unit and the connecting end portion 23 in the rotation direction of the first frame 4. Accordingly, preparation for playing or packing-up can be performed in a short time.

The rotating axis which connects the first frame 4 to the instrument main body 2 is not limited to be integrally formed with the end pin which locks the strap as in all the embodiments described above. The rotating axis may be configured by a connecting screw or a pressing screw which is separated from the end pin, for example.

The connecting end portion 23 of the first frame 4 is not limited to be accommodated in the accommodation groove 31 of the body part 11, and may be placed at the front end surface or the rear end surface 2*e* of the body part 11, for example.

In all the embodiments, only the first frame 4 is set to be a movable frame. Alternatively, both the first frame 4 and the second frame 5, for example, may be set to be movable frames. In this case, a rotating axis of the second frame 5 may be commonly used with the rotating axis of the first frame 4. Alternatively, the rotating axis of the second frame may be provided separately from the rotating axis of the first frame 4 and may be placed in a position obtained by shifting from the rotating axis of the first frame 4.

The folded position 4B of the pair of frames 4 and 5 may be the an arbitrary rotation position of the first side surface 2*c* side, the second side surface 2*d* side, or the rear surface 2*b* side between the first side surface 2*c* side and the second side surface 2*d* side, for example. That is, the rotation angle range of each of the frames 4 and 5 may be set so that the sum of the rotation angle ranges of the two frames 4 and 5 is 180 degrees, or may be set to be, for example, 90 degrees, respectively.

The electric stringed instrument of the present invention is not limited to the electric guitar 1 as the embodiment. An electric stringed instrument according to one embodiment may include the instrument main body 2 over which the plurality of strings 3 are stretched, and the pair of frames 4 and 5 which are placed at sides of both side surfaces 2*c* and 2*d* of the instrument main body 2. The electric stringed instrument of the present invention may be other types of electric stringed instruments such as an electric violin, for example.

What is claimed is:

1. An electric stringed instrument comprising:

an instrument main body that includes front and rear sides, and a rotating axis extending in a longitudinal direction of the instrument main body, the front side including a structure configured to hold a string; and a pair of first and second frames connected to the instrument main body, wherein the first frame is rotatable about the rotating axis toward the second frame while going around the rear side of the instrumental main body, and wherein the instrument main body has a first lateral side and second lateral side that is different from the first lateral side, wherein the second frame is immovably fixed to the instrument main body and disposed at the second lateral side, wherein the first frame is rotatable from the first lateral side to the second lateral side so that the first frame becomes disposed at the second lateral side together with the second frame.

2. The electric stringed instrument according to claim 1, further comprising a fixation mechanism that fixes the first frame to prevent the first frame from rotating from the first lateral side to the second lateral side.

3. An electric stringed instrument comprising:

an instrument main body that includes front and rear sides, and a rotating axis extending in a longitudinal direction of the instrument main body, the front side including a structure configured to hold a string;

a pair of first and second frames connected to the instrument main body, wherein the first frame is rotatable about the rotating axis toward the second frame while going around the rear side of the instrumental main body, and wherein the second frame is immovably fixed to the instrument main body; and a fixation mechanism that fixes the first frame to prevent rotation of the first frame with respect to the instrument main body, wherein the fixation mechanism fixes the first frame in a state where the first and second frames are respectively disposed at both lateral sides of the instrument main body, and wherein the fixation mechanism fixes the first frame in a state where the first and second frames are superposed on each other.

4. The electric stringed instrument according to claim 2, wherein the first frame includes a connecting end portion connected to the instrument main body, the fixation mechanism includes a pair of clamping parts provided on the instrument main body, the pair of clamping parts fixing the connecting end portion by clamping the connecting end portion from the longitudinal direction of the instrument main body.

5. The electric stringed instrument according to claim 2, wherein:

the first frame includes a connecting end portion connected to the instrument main body, the connecting end portion extending from the rotating axis in a radial direction of the rotating axis, the fixation mechanism includes a locking groove and a biasing member, the locking groove is recessed from a surface of the instrument main body in the longitudinal direction of the instrument main body, the locking groove extending in a radial direction of the rotating axis, the locking groove being configured so that the connecting end portion is inserted into the locking groove, and the biasing member biases the connecting end portion toward a direction in which the locking groove is to be inserted.

6. The electric stringed instrument according to claim 2, wherein:

the first frame includes a connecting end portion connected to the instrument main body, the fixation mechanism includes a pressing screw screwed in the instrument main body in the longitudinal direction thereof, the pressing screw pressing the connecting end portion to the instrument main body, and the pressing screw is penetrated through the connecting end portion to rotatably connect the first frame to the instrument main body.

7. The electric stringed instrument according to claim 1, further comprising an identification unit that identifies the first and second frames from each other.

8. The electric stringed instrument according to claim 1, wherein the structure includes a fingerboard including a fret.

9. An electric stringed instrument comprising:

an instrument main body that includes front and rear sides, and a rotating axis extending in a longitudinal direction of the instrument main body, the front side including a structure configured to hold a string; and a pair of first and second frames connected to the instrument main body, wherein the first frame is rotatable about the rotating axis toward the second frame while going around the rear side of the instrumental main body, wherein the second frame is immovably fixed to the instrument main body, wherein the instrument main body has a first lateral side and a second lateral side that is different from the first lateral side, wherein the first frame is positionable at the first lateral side, wherein the second frame is positionable at the second lateral side, and wherein the first frame is rotatable from the first lateral side to the second lateral side while going around the rear side, so that the first frame is superimposed on the second frame.

10. The electric stringed instrument according to claim 1, wherein the first frame has a belt shape and forms a spacing between the first frame and the instrument main body.

11. The electric stringed instrument according to claim 1, wherein the second frame has a belt shape and forms a space between the second frame and the instrument main body.

12. The electric stringed instrument according to claim 1, wherein the first and second frames are separated from each other in a state where the first frame is positioned at the first lateral side and the second frame is positioned at the second lateral side.

13. The electric stringed instrument according to claim 1, wherein the rotating axis includes a connecting screw extending in the longitudinal direction of the instrument main body.

14. The electric stringed instrument according to claim 1, wherein the first frame includes a connecting end portion through which the rotating axis passes.

15. The electric stringed instrument according to claim 1, wherein the longitudinal direction is substantially parallel to the string.

* * * * *